US007699451B2

(12) United States Patent
Nishida

(10) Patent No.: US 7,699,451 B2
(45) Date of Patent: Apr. 20, 2010

(54) PRESSURE RETAINING DEVICE, PRESSURE RETAINING SYSTEM, AND INK JET PRINTER

(75) Inventor: Katsunori Nishida, Aichi-ken (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 662 days.

(21) Appl. No.: 11/633,154

(22) Filed: Dec. 4, 2006

(65) Prior Publication Data

US 2007/0126816 A1 Jun. 7, 2007

(30) Foreign Application Priority Data

Dec. 5, 2005 (JP) ..... 2005-350720

(51) Int. Cl.
*B41J 2/175* (2006.01)

(52) U.S. Cl. ..... 347/85

(58) Field of Classification Search ..... 347/5, 347/84, 85, 86, 87; 141/2, 18
See application file for complete search history.

(56) References Cited

U.S. PATENT DOCUMENTS 4,558,326 A * 12/1985 Kimura et al. ..... 347/30
6,030,074 A * 2/2000 Barinaga ..... 347/85
6,243,115 B1 * 6/2001 Baker et al. ..... 347/85
6,315,402 B1 * 11/2001 Kawase ..... 347/85
6,824,256 B2 * 11/2004 Thielman et al. ..... 347/85
6,935,739 B2 * 8/2005 Inoue et al. ..... 347/104
6,991,313 B2 1/2006 Sasa

FOREIGN PATENT DOCUMENTS

JP 10138506 5/1998
JP 2004-58348 2/2004

* cited by examiner

*Primary Examiner*—Anh T. N. Vo
(74) *Attorney, Agent, or Firm*—Frommer Lawrence & Haug LLP

(57) ABSTRACT

A pressure retaining device for retaining a pressure in a communication passage which are communicated between a supply tank for supplying a first fluid and a nozzle for ejecting the first fluid, comprises a compressing unit provided across an intermediate of the communication passage for compressing the first fluid transferred from the supply tank to the nozzle, and a pump for supplying to the compressing unit a second fluid on which a pressure is loaded thereby. In the construction above, the second fluid is supplied by the pump to the compressing unit to compress the first fluid in the compressing unit, and the first fluid in the nozzle is then compressed by a pressure loaded on the first fluid in the compressing unit.

15 Claims, 7 Drawing Sheets

PRESSURE RETAINING DEVICE, PRESSURE RETAINING SYSTEM, AND INK JET PRINTER

CROSS-REFERENCE OF RELATED APPLICATION

This non-provisional application claims priority under 35 U.S.C. §119(a) on Patent Application No. 2005-350720 in Japan on Dec. 5, 2005, the entire contents of which are hereby incorporated by reference.

BACKGROUND

The present invention relates to a pressure retaining device, a pressure retaining system, and an ink jet printer.

A conventional maintenance (pressure retaining) mechanism comprises, for example as shown in FIG. 1, a printing head 101 having a set of nozzles arranged in rows, an ink cartridge 102 for storing ink to be supplied to the printing head 101, an air pump 103 for pumping compressed air, and a charge tank 104 connected across an air passage between the ink cartridge 102 and the air pump 103 for temporarily storing the compressed air. The conventional maintenance mechanism further includes, for example, an open/close relief valve 105 connected across an air passage between the charge tank 104 and the air pump 103 and a compressing open/close valve 106 connected across an air passage between the ink cartridge 102 and the charge tank 104, thus allowing the compressed air generated by the air pump 103 to be applied to the ink in the ink cartridge 102 for positive pressure purging and then exposure to the atmosphere after a predetermined length of time.

When employed in an ink jet recording apparatus, the conventional maintenance mechanism may be accompanied with a carriage which carries a printing head and a sub tank unit. The conventional maintenance mechanism also includes an ink cartridge connected by a supply tube to the printing head, an air pump for supplying the ink cartridge with compressed air, a pressure regulator, and a switching valve. When the storage of ink in the sub tank becomes smaller, the switching valve is turned on for communicating between the air pump and an ink bag in the ink cartridge. This permits the compressed air to be delivered from the air pump via the pressure regulator and the switching valve to the ink bag from which the ink is transferred to the printing head or the sub tank (See Japanese Patent Application Laid-Open No. 10-138506, Paragraphs 0030 to 0037 and FIGS. 3 and 4).

However, in the prior arts shown in FIG. 1 and depicted in the Japanese Patent Application Laid-Open No. 10-138506, as the relief valve and the pressure regulator are connected between the (air) pressure pump and the ink tank (ink cartridge), they are actuated for controlling the compressed air delivered from the (air) pressure pump to the ink tank (ink cartridge). Accordingly, since its space for installing a large part such as the relief valve or the pressure regulator is essential, the ink jet printer will become large in the overall size and be increased in the production cost. Also, since the flow of the compressed air to be delivered to the ink cartridge is determined by the volume of the pressure regulator provided at the front side (the upstream side) of the ink cartridge, its pressure applied to the printing head will be varied depending on the remaining amount of the ink in the ink cartridge.

For controlling the compressed air with ease and less cost, a mechanism has been proposed where an orifice is provided in the air supply conduit extending from the air pump to the air chamber of the ink cartridge for discharging the compressed air generated by the air pump from the orifice to control the pressure and conduct the purging action (For example, see Japanese Patent Application Laid-Open No. 2004-58348, Paragraphs 0031 to 0035 and FIG. 6).

SUMMARY

As the ink in the ink cartridge is consumed, the air in the ink cartridge will increase. It is hence necessary for conducting the purging action consistently regardless of an increase in the air and holding the printing head at a stable, uniform level of the pressure to modify the charge of air to be supplied to the charge tank in response to the consumption of the ink in the ink cartridge. This may hardly be consulted by the prior art disclosed in the Japanese Patent Application Laid-Open No. 2004-58348.

When the ink cartridge is large in volume, its contained air will be varied significantly from the start to the end of the consumption of the ink. It is hence needed to increase the volume of the charge tank correspondingly. It is also needed for charging the charge tank with a large amount of air to have the air pump of a large sized, high pumping capacity type. As the result, the printer will be increased in the overall size.

It is hence an object to provided a pressure retaining device, a pressure retaining system, and an ink jet printer which are capable of decreasing the charging volume and keeping the purging discharge substantially uniform throughout the consumption of ink from the start to the end, whereby the overall size can be minimized. It is also another object to provide a pressure retaining device, a pressure retaining system, and an ink jet printer which are capable of conducting the purging action with the use of a desired level of the pressure regardless of the remaining amount of ink.

For achievement of the above object, there is provided a pressure retaining device according to an aspect for retaining a pressure in a communication passage which are communicated between a supply tank for supplying a first fluid and a nozzle for ejecting the first fluid, comprising:

a compressing unit provided across an intermediate of the communication passage for compressing the first fluid transferred from the supply tank to the nozzle; and a pump for supplying to the compressing unit a second fluid on which a pressure is loaded thereby, wherein the second fluid is supplied by the pump to the compressing unit to compress the first fluid in the compressing unit, and the first fluid in the nozzle is then compressed by a pressure loaded on the first fluid in the compressing unit.

The compressing unit may be of either a type for directly compressing the first fluid (ink) in the compressing unit by the action of the second fluid or a type for compressing the ink with the use of an intermediate membrane such as a film.

As set forth above, the aspect allows the compressing units to be provided across the ink passages between the supply tanks (ink cartridges) and the nozzles (in the printing head) for distributing the ink from the ink cartridges to the printing head. Since the compressing units are supplied with the compressed air from the pump, their contained ink is compressed, thus exerting the pressure over the ink in the nozzles of the printing head. As the result, the charging size can be minimized while a switching mechanism such as a switching valve is not needed, hence advantageously encouraging the space saving. Also, the ink cartridges are not loaded with a back pressure and their purging action can be substantially uniform in the discharge throughout the service period from the start to the end.

The above and further objects and features will more fully be apparent from the following detailed description with accompanying drawings.

DETAILED DESCRIPTION

An embodiment will be described referring the relevant drawings.

Figure 1:
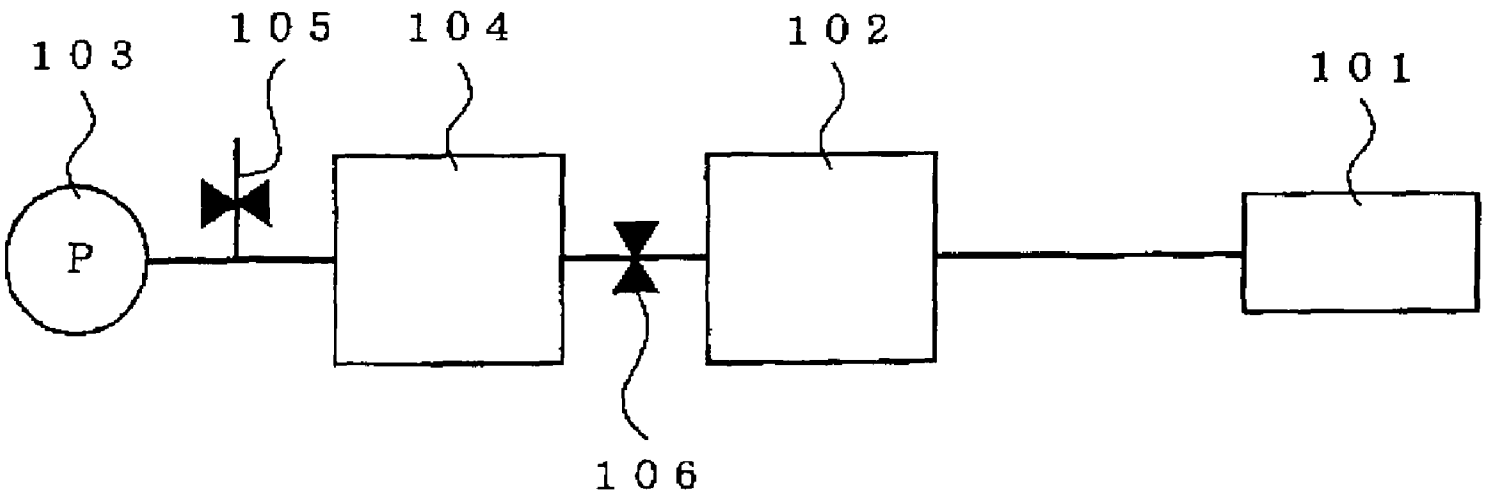
FIG. 1 PRIOR ART
FIG. 1 is a schematic structural view of an ink jet printer according to the prior art.
Figure 2:
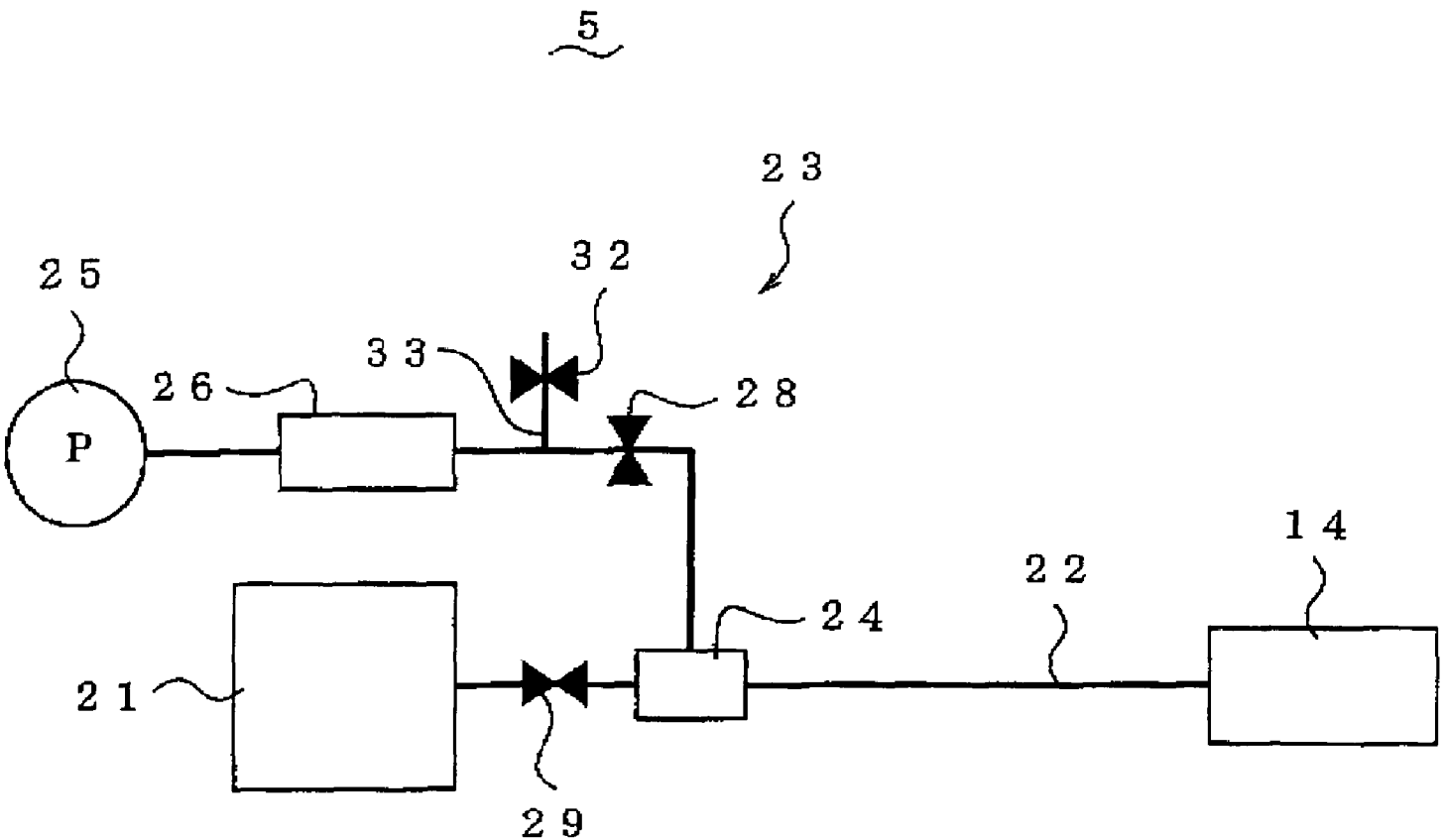
FIG. 2 is a schematic structural view of an ink jet printer showing an embodiment.

FIG. 2 is a schematic structural view of an ink jet printer according to the embodiment.

As shown in FIG. 2, the ink jet printer 5 includes a printing head 14 equipped with a plurality of nozzles, an ink cartridge (supply tank) 21 for storing ink to be delivered to the printing head 14, and a positive pressure recovering means 23 for applying a pressure to the ink in the nozzles of the printing head 14 in the direction of blow. The positive pressure recovering means 23 has a compressing unit 24 provided across an ink passage 22 between the ink cartridge 21 and the printing head 14, thus allowing the ink to delivered from the ink cartridge 21 across the compressing unit 24 to the printing head 14. The positive pressure recovering means 23 also includes, in addition to the compressing unit 24, a air pump 25 (e.g., a tube pump) for acting as a pumping means to deliver compressed air to the pressuring unit 24, a charge tank (reservoir) 26 for temporarily saving the compressed air received from the air pump 25, a compressing solenoid valve (control valve, regulating valve) 28 for transferring the compressed air from the charge tank 26 to the compressing unit 24, and an atmospheric exhaust solenoid valve (relief valve) 32 for discharging the compressed air in the charge tank 26 to the atmosphere. The charge tank 26 and the compressing solenoid valve 28 are connected in this order from the upstream between the air pump 25 and the compressing unit 24. An air passage 33 across which the atmospheric exhaust solenoid valve 32 is provided is communicated to the air passage between the charge tank 26 and the compressing solenoid valve 28. The atmospheric exhaust solenoid valve 32 may be connected directly to the charge tank 26. A check valve 29 is connected between the ink cartridge 21 and the compressing unit 24 for inhibiting the ink from flowing back from the compressing unit 24 to the ink cartridge 21. Accordingly, the transfer of pressure to the printing head during the positive pressure purging can be improved in the efficiency.

The positive pressure recovering means 23 is arranged for, during the positive pressure purging, shutting up the compressing solenoid valve 28 to temporarily save the compressed air in the charge tank 26 and then opening the compressing solenoid valve 28 to transfer the compressed air to the compressing unit 24 where the ink is compressed before released from the nozzles of the printing head 14. The positive pressure recovering means 23 is arranged for, after the purging action, opening the atmospheric exhaust solenoid valve 32 to communicate the charge tank 26 by the air passage 33 to the atmosphere.

This allows the amount of the ink in the compressing unit 24 (sub tank) to remain uniform, hence minimizing a change in the air amount in the compressing unit 24. As the result, the ink to be released from the nozzles of the printing head 14 can stay at a uniform level of the pressure.

Since the compressing unit 24 is reduced in the volumetric size, the volumetric size of the charge tank 26 and the dimensions of the air pump 25 can be minimized.

In addition, the ink cartridge 21 is, unlike that of the prior art, not loaded with a back pressure, and can thus be increased in the freedom of design. In other words, the ink cartridge will be not limited in the mass capacity.

The two solenoid valves 28 and 32 may be replaced by manually opening/closing valves.

The application of the ink jet printer to a multi-function copier (MFC) 1 which has a printer function, a copier function, a scanner function, and a facsimile function will now be described.

Figure 3:
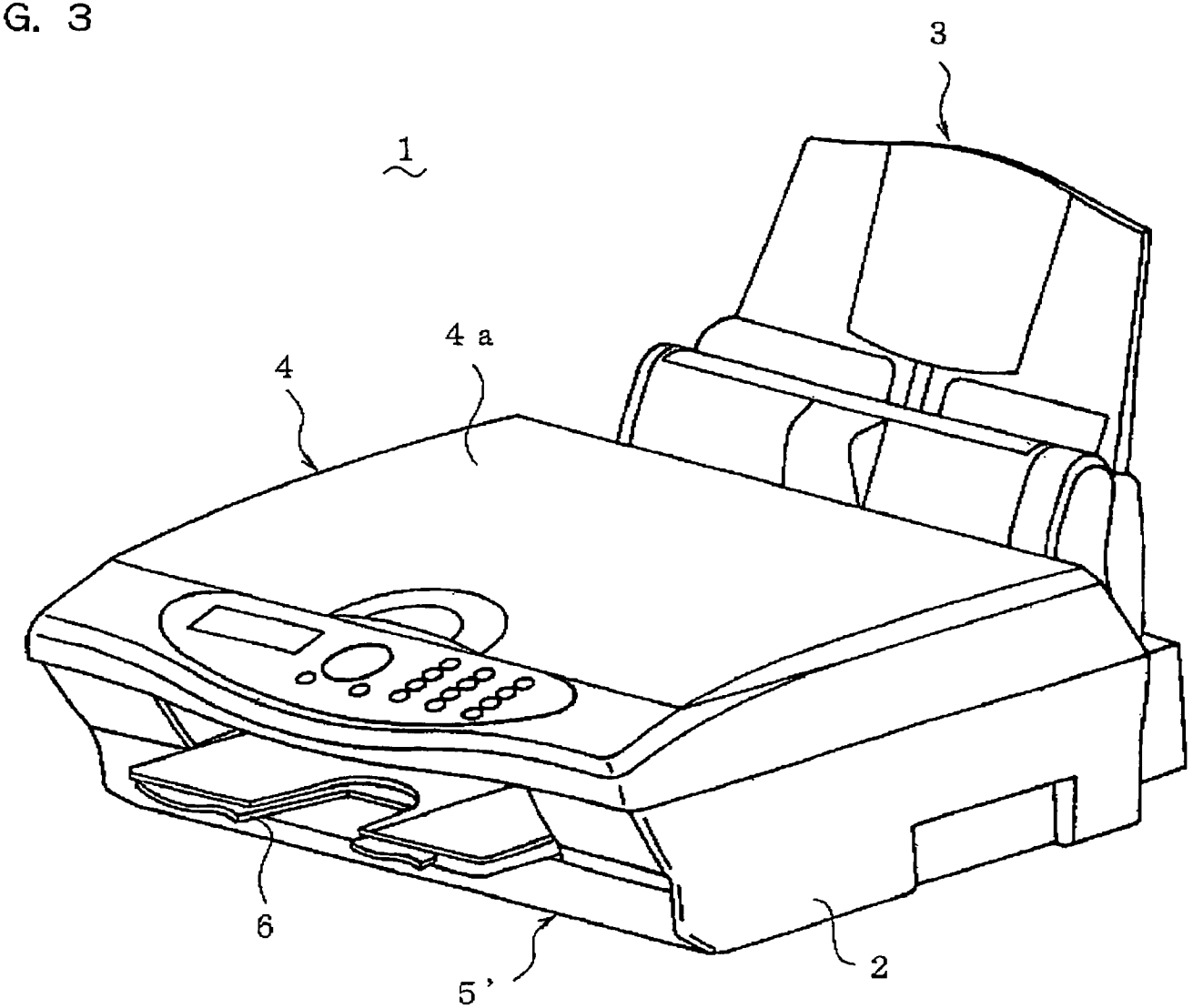
FIG. 3 is a perspective view of a multi-function copier (MFC) in which the ink jet printer is installed.
Figure 4:
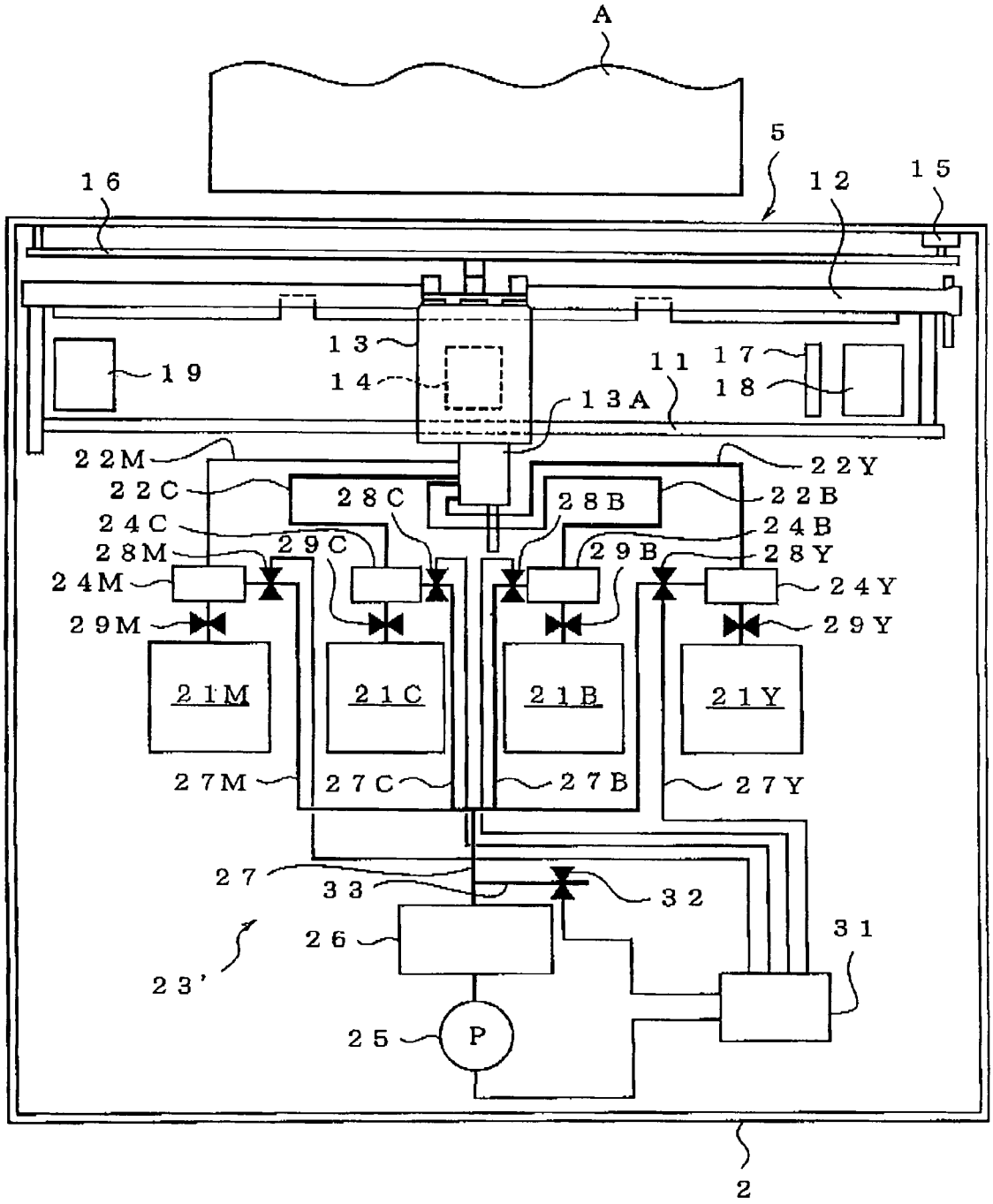
FIG. 4 is a schematic structural view of an ink jet printer of an embodiment.

FIG. 3 is a perspective view of the MFC where the ink jet printer of the embodiment is commonly installed and FIG. 4 is a schematic structural view of the ink jet printer.

As shown in FIGS. 3 and 4, the MFC 1 includes a main housing 2 where a paper feeder 3 is mounted at the read end. The interior of the main housing 2 is largely separated into two, upper and lower, sections depending on the installed functions. An original reader 4 having the copier function and the facsimile function is mounted at the upper section of the main housing 2. The ink jet printer denoted by 5' having the printer function is mounted at the lower section or lower half of the main housing 2 while a paper discharge tray 6 for receiving sheets of recording medium or paper P on which a record is printed and discharged is mounted at the front of the ink jet printer 5'.

Although not specifically shown, the original reader 4 is mounted to the rear end for upward and downward pivotal movement about the horizontal axis. In action, when a cover 4*a* is pulled upwardly for opening, the original table glass on which an original is placed is exposed under which an image scanner for reading the original is disposed.

The ink jet printer 5' has the head holder 13 movably mounted as a carriage on a pair of guide shafts 11 and 12 which extend in parallel to each other in the main housing 2. The printing head 14 is downwardly mounted to the head holder 13 for releasing a jet of the ink from its nozzles towards a sheet of recording paper A. The head holder 13 (with the printing head 14) is joined to an endless belt 16 which is driven by a motor 15 for circular traveling 80 that it can move forward and backward along the two guide shafts 11 and 12 for printing.

A wiper means 17 for wiping out the openings of the nozzles with its wiper member and a flushing tank (waste tank) 18 for receiving and saving the remaining of the ink subjected to the purging and the flushing are disposed at one end of the stroke of the forward and backward movement. At the other end, a storage cap means 19 is provided for protecting the nozzles of the printing head 14 with its storage cap in a non-printing state.

In the ink jet printer 5', four ink cartridges 21M, 21C, 21B, and 21Y for storing magenta color ink, cyan color ink, black color ink, and yellow color ink respectively to be supplied to the printing head 14 are installed at this side of the center. The four ink cartridges 21M, 21C, 21B, and 21Y can be exposed and replaced with new ones, as necessary, through upwardly pivoting the original reader 4 to open the main housing 2.

The four ink cartridges 21M, 21C, 21B, and 21Y are communicated by four ink passages 22M, 22C, 22B, and 22Y respectively to a tube joint 13A in the head holder 13 for supplying the printing head 14 with their respective colors of the ink. Also, the four ink cartridges 21M, 21C, 21B, and 21Y are communicated with a positive pressure recovering means 23' for exerting a positive pressure in the direction of jetting on the ink in the nozzles of the printing head 14.

The positive pressure recovering means 23' is similar to the positive pressure recovering means 23 described previously. The positive pressure recovering means 23' comprises four compressing units 24M, 24C, 24B, and 24Y which are connected across their respective ink passages 22M, 22C, 22B, and 22Y between the ink cartridges (supply tanks) 21M, 21C, 21B, and 21Y and the printing head 14 (at the tube joint 13A) and an air pump 25 (the pumping means) for delivering the compressed air to the compressing units 24M, 24C, 24B, and 24Y. The pressuring units 24M, 24C, 24B, and 24Y serve as portions of the ink passages for conveying their respective colors of the ink from the four ink cartridges 21M, 21C, 21B, and 21Y to the printing head 14. The compressed air produced by the action of the air pump 25 is exerted on the ink of the different colors in their respective compressing units 24M, 24C, 24B, and 24Y as well as the ink of the different colors in the nozzles of the printing head 14. A charge tank (reservoir) 26 for reserving the compressed air is connected commonly with the four compressing units 24M, 24C, 24B, and 24Y.

Figure 5:
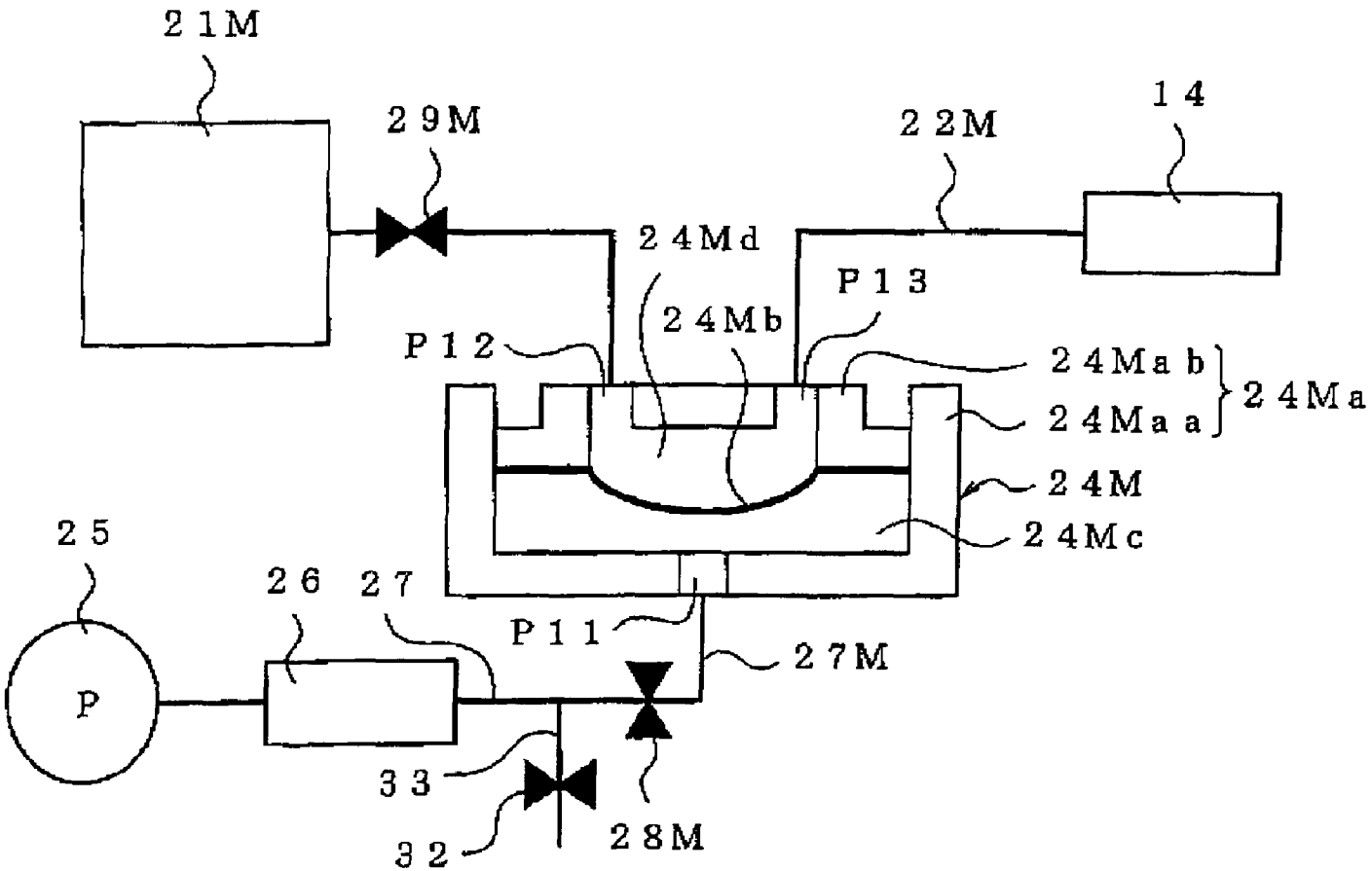
FIG. 5 is a detailed view of a compressing unit.

The four compressing units 24M, 24C, 24B, and 24Y include their respective sub tanks where the ink is present simultaneously with the compressed air. The sub tank is separated into an air chamber and an ink chamber. More particularly, the sub tank 24M*a* of the pressuring unit 24M, for example as shown in FIG. 5, is separated by a flexible film (flexible member) 24M*b* into an air chamber 24M*c* for receiving the compressed air and an ink chamber 24M*d* through which the color ink is conveyed from the ink cartridge (supply tank) 21M to the printing head 14 (with the nozzles). In other words, the flexible film (flexible member) 24M*b* acts as a partition between the air chamber 24M*c* and the ink chamber 24M*d*. The sub tank 24M*a* has a second tank member 24M*ab* with an ink passage fitted into a first tank member 24M*aa* which provides a region of the air chamber 24*c*. The flexible film 24M*b* is water-tightly bonded at the circumferential edge to the second tank member 24M*ab*. The air chamber 24M*c* is defined between the two tank members 24M*aa* and 24M*ab* which are joined tightly to each other. The flexible film 24M*b* acts as a wall of the air chamber 24M*c*. The first tank member 24M*aa*has a port P11 provided therein for communicating with the air passage 27M to supply the compressed air. The second tank member 24M*ab* has two ports P12 and P13 provided therein for delivering the ink to the printing head 14. The sub tank 24M*a* permits the compressed air and the ink to be present simultaneously as separated by the flexible film 24M*b*. Each of the four compressing units 24M, 24C, 24B, and 24Y is arranged where the air chamber is located lower along the direction of gravity than the ink chamber, whereby the flexible film 24M*b* can downwardly be biased when at least some of the ink remains in the ink chamber.

The compressed air received from the air pump 25 is temporarily saved in the common charge tank (reservoir) 26 before distributed to the compressing units 24M, 24C, 24B, and 24Y respectively. Four compressing solenoid valves 28M, 28C, 28B, and 28Y for being opened at the positive pressure purging action are provided across their respective air passages 27M, 27C, 27B, and 27Y between the charge tank 26 and the compressing units 24M, 24C, 24B, and 24Y. The opening of the valves 28M, 28C, 28B, and 28Y allow the compressing units 24M, 24C, 24B, and 24Y to receive the compressed air. At the time, flexible film 24M*b* separating between the air chamber and the ink chamber is biased upwardly to deliver the color ink in the ink chamber to the printing head 14. As the air passages 27M, 27C, 27B, and 27Y are branched from the air output line 27 at the downstream of the common charge tank 26. The air output line 27 is also communicated with an air passage 33 across which an atmospheric exhaust solenoid valve 32. Four check valves 29M, 29C, 29B, and 29Y are disposed across their respective ink passages 22M, 22C, 223, and 22Y between the compressing units 24M, 24C, 24B, and 24Y and the ink cartridges 21M, 21C, 21B, and 21Y respectively for prohibiting the corresponding colors of the ink from running back from the compressing units 24M, 24C, 24B, and 24Y to the ink cartridges 21M, 21C, 21B, and 21Y.

For controlling the action of the air pump 25, the atmospheric exhaust solenoid valve 32, and the compressing solenoid valves 28M, 28C, 28B, and 28Y, a recovery controlling means (controller) 31 is provided which may preferably be a microcomputer. The recovery controlling means 31 shuts up the atmospheric exhaust solenoid valve 32 and the compressing solenoid valves 28M, 28C, 28B, and 28Y for the positive pressure recovering action and then the air pump 25 starts rotating to increase the pressure of air and supply the charge tank (reservoir) 26 and the air passages with the compressed air. In this embodiment, the air pump 25 remains driven until the pressure increases up to a predetermined level. This is followed by opening one or more the compressing solenoid valves 28M, 28C, 28B, and 28Y for a desired length of time in order to exert the pressure on their corresponding colors of the ink in the nozzles of the printing head 14. The discharge of the compressed air from the charge tank 26 depends on the arrangement of the air chamber of each compressing unit and its upstream passage. Accordingly, the pressure to be exerted can remain uniform regardless of the remaining amounts of the ink in the ink cartridges 21M, 21C, 21B, and 21Y.

When the desired length of time has elapsed, the atmospheric exhaust solenoid valve (relief valve) 32 is opened and the compressed air in the charge tank (reservoir) 26 is discharged under the controlling action. The purging action over the nozzle for a selected color ink is then followed by the flushing action in which all the compressing solenoid valves 28M, 28C, 28B, and 28Y remain opened.

As the result, the pressure in the charge tank 26 is increased to a predetermined level. Then, the compressed air from the charge tank 26 is exerted on the ink of the different colors in the nozzles of the printing head 14 for conducting the positive pressure purging action.

Figure 6:
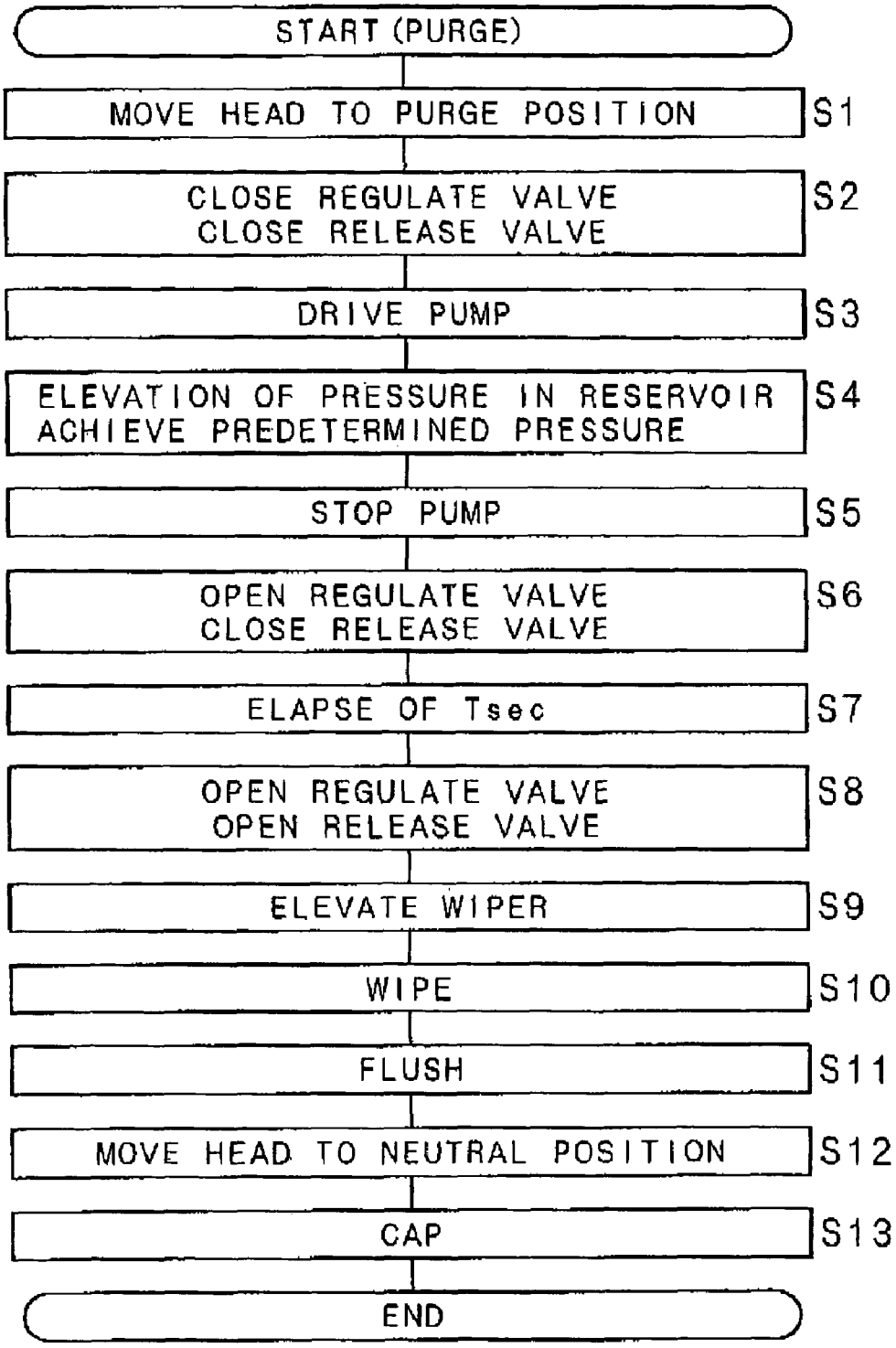
FIG. 6 is a flowchart showing a procedure of the controlling action.
Figure 7:
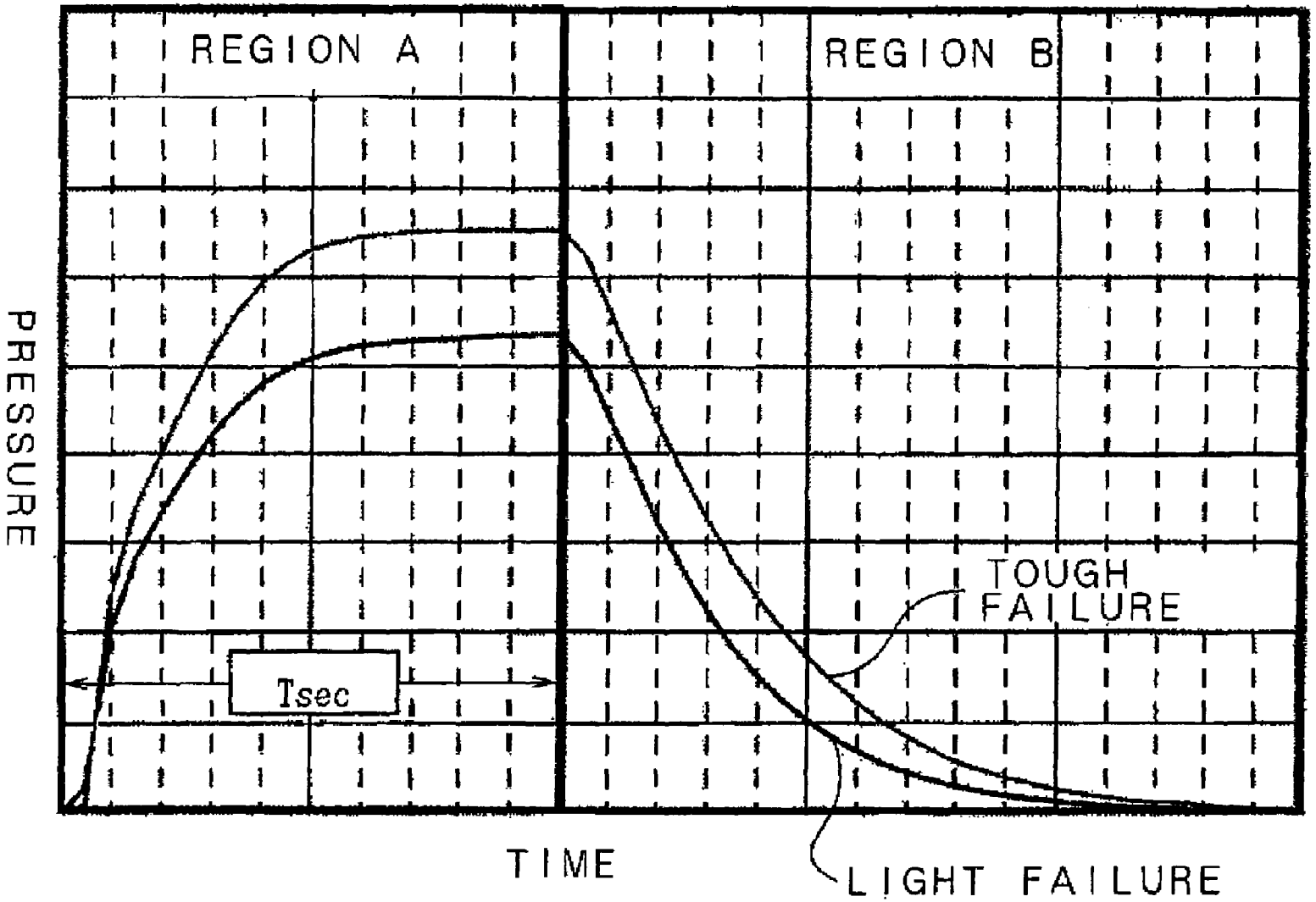
FIG. 7 is a diagram showing the relationship between elapsed time and pressure.

Next, the controlling action of the recovery controlling means (controller) 31 will be described referring to FIG. 6.

For example, when the action of printing down has been completed; a command for starting the purging action is received as programmed. In response, the printing head 14 on the head holder 13 is moved to its purging position which faces the flushing tank 18 (Step S1). The compressing solenoid valves (control valves, regulating valves) 28M, 28C, 28B, and 28Y and the atmospheric exhaust solenoid valve (relief valve) 32 is shifted from the opening position to the closing position or remain closed (Step S2). This is followed by starting the air pump 25 (Step S3). Then, the charge tank 26 is filled with the compressed air.

The pressure is gradually increased and reaches at its predetermined level in the charge tank 26 (Step S4) and the action of the air pump 25 is canceled (Step S5). As the air pump 25 is deactivated, the compressing solenoid valves (regulating valves) 28M, 28C, 28B, and 28Y are opened (Step S6). This allows the compressing units 24, 24C, 24B, and 24Y to be loaded with the compressed air, hence exerting a back pressure over the ink of the different colors in the ink cartridges 21M, 21C, 21B, and 21Y and exhausting the flushing tank 18 through the positive pressure purging action. When the positive pressure purging action is intended to a selected color of the ink in the nozzle, the compressing solenoid valve corresponding to the nozzle for the ink only is opened. When the positive pressure purging action is intended to all the colors of the ink in the nozzles, all the four compressing solenoid valves 28M, 28C, 28B, and 28Y are opened up.

As a predetermined length of time Tsec has elapsed (Step S7), the atmospheric exhaust solenoid valve (relief valve) 32 is opened (Step S8), the wiper member of the wiper means 17 is lifted up (Step S9), and its wiping action is carried out as the printing head 14 moves (Step S10). The paragraph "as the predetermined length of time Tsec has elapsed" may be replaced by "when the action of the air pump 25 has conducted a predetermined number of revolutions". When the positive pressure purging action is intended to the selected color of the ink in the nozzle, not corresponding ones of the compressing solenoid valves remain closed. However, the pressure in the charge tank 26 returns back to the atmospheric level during the wiping action.

After the wiping action for the nozzle of the selected color ink subjected to the positive pressure purging action, the not corresponding ones of the compressing solenoid valves are opened. After the wiping action for all the nozzles of the colors of the ink, the procedure simply advances to the succeeding step. The printing head 14 is moved again to the purging position and the flushing action is carried out for preventing no mixture of the different colors of the ink (Step S11). This is followed by the printing head 14 moving to the standby position (neutral position) which faces the storage cap means 19 (Step S12) and being covered with the storage caps of the storage cap means 19 (Step S13) before the procedure is ended.

The foregoing arrangement may be modified as follows.

(i) While the ink cartridges 21M, 21C, 21B, and 21Y are communicated to the common charge tank 26 in the above embodiment, they may be accompanied with their respective charge tanks on the one-by-one basis. In the latter case, since the ink cartridges 21M, 21C, 21B, and 21Y are connected to the four is corresponding charge tank, the storage size of each charge tank is hence equal to ¼ the size of the common charge tank 26. Accordingly, the air passages 27 can be simplified in the construction for communication thus contributing to the improvement of the space saving and minimizing the number of the relevant components.

(ii) While the recovery controlling means (controller) in the embodiment is arranged to exert a uniform level of the pressure (so-called charging pressure) on the ink in the nozzles of the printing head, it may drive the positive pressure recovering means to, in response to a degree of printing error (fault in the delivery of the ink), modify the pressure (so-called charging pressure) to be exerted on the ink in the nozzles of the printing head to a higher level when the degree of printing error is crucial than when the degree of printing error is not crucial throughout the duration of time A from the opening of the compressing solenoid valves to the end of the period Tsec. If the charging pressure remains uniform but not modified, the printing head remains consistent under the pressure regardless of the degree of printing error (crucial or not) and may thus increase the consumption of the ink in vain.

The degree of printing error (fault in the delivery of the ink) may be examined by a user judging and entering the result of the judgment (crucial or not) with a manual switch or by an imaging means such as a CCD camera shooting the sheet of recording paper and subjecting its image output signal to a known image processing action.

In practice, the recovery controlling means (controller) can modify the pressure through varying the compressed air saved in the charge tank, changing the length of the air passage, or adjusting the supply of air to be received by the compressing units 24M, 24C, 24B, and 24Y with the action of the pump 25.

(iii) The sub tank may be adjusted to a desired storage size depending on the resistance in the air passages connected thereto. More particularly, when the resistance in the air passages is high, the storage size of the sub tank is reduced thus to hasten the increase of the air pressure. Alternatively, when the resistance in the air passages is low, the storage size of the sub tank is increased thus to retard the increase of the air pressure. Also, the sub tanks for all the colors of the ink may be set substantially equal in the internal pressure. In other words, the ink chamber and the air chamber in each sub tank are determined in the storage size depending on the resistance in the ink passage connected to the compressing unit.

(iv) While all the compressing solenoid valves 31M, 31C, 31B, and 31Y are opened with the nozzles for all the colors of the ink to be subjected to the purging action in the embodiment, they may be opened one by one in a sequence for subjecting the nozzles for each color of the ink to the positive pressure purging action or conducting the positive pressure purging action over the nozzles for all the colors of the ink.

(v) While the embodiment is applied as an ink jet printer in a multi-function copier (MFC), it may be utilized in any common ink jet printer where the recovery controlling means is provided in the form of an external recovery controlling means in a personal computer.

According to the embodiment, the compressing units are provided across the ink passage between the ink cartridge and the printing head in the embodiment for conveying the ink from the ink cartridge to the printing head, loaded with the compressed air produced by the pumping means, and actuated for compressing the ink in the compressing units and thus supplying the nozzles of the printing head with the compressed ink by the compressing units. It is therefore unnecessary to increase the internal size of the compressing units, thus minimizing the charging size. More specifically, the recovery for delivery can be improved, the consumption of the ink can be decreased, and the time required for the purging action can be shortened. Also, since a switching mechanism such as a switching valve is not needed, the embodiment can be advantageous in the space saving.

In addition, the embodiment permits each compressing unit across the ink passage between the ink cartridge and the printing head to be loaded with a pressure, unlike the prior art where a back pressure is applied to the ink cartridge. Accordingly, the pressure to be applied remains almost uniform regardless of the remaining amount of the ink in the ink cartridge, hence ensuring the purging action with substantially a uniform discharge throughout the start to the end of the consumption in the ink cartridge. In particular, since the compressing units are low in the change of the air volume, variations of the discharge in the purging action can advantageously be suppressed.

According to the embodiment, the return of the ink from the compressing units to the ink cartridges is inhibited by the action of the check valves, thus allowing the force of pressure exerted on the ink in the compressing units by the compressed air from the pumping means to be not received by the ink cartridges. As the result, the transfer of the pressure to the printing head will be improved in the efficiency.

According to the embodiment, the force of pressure introduced to the air chamber by the compressed air is transferred to the ink in the ink chamber by the biasing action of the flexible film before exerted on the ink in the nozzles of the printing head. In particular, since the ink chamber is isolated by the flexible film, no ink leakage from the ink chamber will be permitted.

According to the embodiment, the positive pressure purging action, the wiping action, and the flushing action are conducted at one end of the stroke of the forward and backward movement of the printing head during the purging action. When the printing action has been ceased, the printing head is held at the other end of the stroke of its forward and backward movement and its nozzles are protected with the storage cap.

According to the embodiment, the positive pressure recovering action can be carried out through controlling the compressing solenoid valves and the atmospheric exhaust solenoid valve with no use of a switching mechanism such as a switching valve.

According to the embodiment, the compressing units are provided for their respective ink cartridges and the printing head and loaded with a pressure for exerting the pressure on the ink in the nozzles of the printing head separately, allowing the common charge tank to remain not increased in the storage size.

According to the embodiment, the pressure in the charge tank can be increased to a desired level within a given period of time regardless of the resistance in the ink passages connected to the charge tank.

According to the embodiment, the positive pressure recovering action can be conducted depending on the degree of printing error, thus permitting no unwanted, wasteful consumption of the ink.

According to the embodiment, the compressed air to be supplied to the compressing units can be modified thus to conduct the positive pressure recovering action at optimum simply and easily depending on the degree of printing error.

According to the embodiment, the recovery controlling means may be implemented by a built-in microcomputer or an external device in a personal computer. This allows the ink jet printer to employ no recovery controlling means.

As this description may be embodied in several forms without departing from the spirit of essential characteristics thereof, the present embodiments are therefore illustrative and not restrictive, since the scope is defined by the appended claims rather than by description preceding them, and all changes that fall within metes and bounds of the claims, or equivalence of such metes and bounds thereof are therefore intended to be embraced by the claims.

What is claimed is:

1. A pressure retaining device for retaining a pressure in a communication passage which are communicated between a supply tank for supplying a first fluid and a nozzle for ejecting the first fluid, comprising:

a compressing unit provided across an intermediate of the communication passage for compressing the first fluid transferred from the supply tank to the nozzle;

a pump for supplying to the compressing unit a second fluid on which a pressure is loaded thereby;

a reservoir, through which the compressing unit is communicated to the pump, for holding the second fluid supplied by the pump;

a relief valve provided on the reservoir for releasing an inner pressure in the reservoir;

a control valve provided between the compressing unit and the reservoir for controlling supply of the second fluid from the reservoir to the compressing unit; and a controller capable of performing operation of:

closing the relief valve;

closing the control valve;

supplying the second fluid to the reservoir by the pump for a predetermined period of time;

opening the control valve for a predetermined period of time to compress the first fluid in the compressing unit; and opening the relief valve;

wherein the second fluid is supplied by the pump to the compressing unit to compress the first fluid in the compressing unit; and wherein the first fluid in the nozzle is then compressed by a pressure loaded on the first fluid in the compressing unit.

2. The pressure retaining device according to claim 1, further comprising:

a check valve provided between the supply tank and the compressing unit.

3. The pressure retaining device according to claim 1;

wherein the compressing unit comprises:

a first chamber through which the first fluid passes from the supply tank to the nozzle;

a second chamber, to which the second fluid is supplied by the pump, disposed adjacent to the first chamber; and a flexible member as a partition disposed between the first chamber and the second chamber.

4. The pressure retaining device according to claim 1, further comprising:

a wiper for wiping an opening of the nozzle;

a waste tank for storing the first fluid ejected from the nozzle; and a cap for covering the opening of the nozzle.

5. The pressure retaining device according to claim 1;

wherein the first fluid is ink while the second fluid is air.

6. The pressure retaining device according to claim 1;

wherein a plurality of the supply tanks are provided, corresponding to each supply tank compressing unit being provided, and are communicated commonly to the reservoir, the controller is composed for:

communicating with the compressing units and the pump, and adjusting a pressure which is exerted on the first fluid in response to a degree of fault in ejection of the first fluid from the nozzle.

7. The pressure retaining device according to claim 6;

wherein the controller is composed for adjusting the pressure by changing a flow of the second fluid supplied by the pump to the compressing units.

8. An ink jet printer comprising:

the pressure retaining device as set forth in claim 1; and an ink jet head equipped with the nozzle ejecting an ink transferred from an ink cartridge for forming an image on a recording medium;

wherein the first fluid is the ink while the supply tank is the ink cartridge.

9. A pressure retaining device for retaining a pressure in a communication passage which are communicated between a supply tank for supplying a first fluid and a nozzle for ejecting the first fluid, comprising:

a compressing unit provided across an intermediate of the communication passage for compressing the first fluid transferred from the supply tank to the nozzle;

a pump for supplying to the compressing unit a second fluid on which a pressure is loaded thereby;

a reservoir, through which the compressing unit is communicated to the pump, for storing the second fluid supplied by the pump;

a relief valve provided on the reservoir for releasing an inner pressure in the reservoir;

a control valve provided between the compressing unit and the reservoir for controlling supply of the second fluid from the reservoir to the compressing unit; and means for controlling a pressure retaining action of the pressure retaining device, the means driving the pump for a period of time to increase the pressure in the reservoir, opening the control valve for a period of time to compress the first fluid in the compressing unit, exerting a pressure on the first fluid in the nozzle, and when the period of time has elapsed, opening the relief valve;

wherein the second fluid is supplied by the pump to the compressing unit to compress the first fluid in the compressing unit; and wherein the first fluid in the nozzle is then compressed by a pressure loaded on the first fluid in the compressing unit.

10. A pressure retaining device for retaining a pressure in a communication passage which are communicated between a supply tank for supplying a first fluid and a nozzle for ejecting the first fluid, comprising:

a compressing unit provided across an intermediate of the communication passage for compressing the first fluid transferred from the supply tank to the nozzle; and a pump for supplying to the compressing unit a second fluid on which a pressure is loaded thereby;

wherein the second fluid is supplied by the pump to the compressing unit to compress the first fluid in the compressing unit;

wherein the first fluid in the nozzle is then compressed by a pressure loaded on the first fluid in the compressing unit;

wherein a plurality of the supply tanks are provided, and corresponding to each supply tank the compressing unit is provided;

wherein the plurality of the supply tanks are communicated commonly to the reservoir, and wherein the controller is composed for:

communicating with the compressing units and the pump; and adjusting a pressure which is exerted on the first fluid in response to a degree of fault in ejection of the first fluid from the nozzle.

11. The pressure retaining device according to claim 10;

wherein the controller is composed for adjusting the pressure by changing a flow of the second fluid supplied by the pump to the compressing units.

12. The pressure retaining device according to claim 10;

wherein volumes of the first chamber and the second chamber are set depending on resistance in a passage of the first fluid communicated to each compressing unit.

13. A pressure retaining system comprising:

a pressure retaining device for retaining a pressure in a communication passage which are communicated between a supply tank for supplying a first fluid and a nozzle for ejecting the first fluid, including:

a compressing unit provided across an intermediate of the communication passage for compressing the first fluid transferred from the supply tank to the nozzle;

a pump for supplying to the compressing unit a second fluid on which a pressure is loaded thereby;

a reservoir, through which the compressing unit is communicated to the pump, for storing the second fluid supplied by the pump;

a relief valve provided on the reservoir for releasing an inner pressure in the reservoir;

a control valve provided between the compressing unit and the reservoir for controlling supply of the second fluid from the reservoir to the compressing unit, and a controller capable of performing operations of:

closing the relief valve;

closing the control valve;

supplying the second fluid to the reservoir by the pump for a predetermined period of time;

opening the control valve for a predetermined period of time to compress the first fluid in the compressing unit; and opening the relief valve;

wherein the second fluid is supplied by the pump to the compressing unit to compress the first fluid in the compressing unit; and wherein the first fluid in the nozzle is then compressed by a pressure loaded on the first fluid in the compressing unit.

14. The pressure retaining system according to claim 13;

wherein the controller is composed for:

communicating with the compressing unit and the pump; and adjusting a pressure which is exerted on the first fluid in response to a degree of fault in ejection of the first fluid from the nozzle.

15. The pressure retaining system according to claim 14;

wherein the controller is composed for adjusting the pressure by changing a flow of the second fluid supplied by the pump to the compressing unit.

* * * * *